United States Patent [19]

Ganser et al.

[11] Patent Number: 4,748,381

[45] Date of Patent: May 31, 1988

[54] CIRCUIT ARRANGEMENT FOR A.C. OPERATION OF GAS DISCHARGE LAMPS

[75] Inventors: Hans-Günther Ganser, Stolberg; Ralf Schäfer, Aachen; Hans-Peter Stormberg, Stolberg, all of Fed. Rep. of Germany

[73] Assignee: U.S. Philips Corporation, New York, N.Y.

[21] Appl. No.: 928,146

[22] Filed: Nov. 7, 1986

[30] Foreign Application Priority Data

Nov. 19, 1985 [DE] Fed. Rep. of Germany ..... 3540985

[51] Int. Cl.[4] ..... H05B 41/16; H05B 41/24

[52] U.S. Cl. ..... 315/200 R; 315/205; 315/226; 315/253; 315/265; 315/272; 315/275; 315/307; 315/308; 315/DIG. 7; 315/208; 315/227 R; 315/283; 307/64; 307/65; 307/66; 363/37

[58] Field of Search ..... 315/200 R, DIG. 7, 205, 315/226, 253, 265, 272, 275, 307, 308, 208, 283, 227 R; 307/64, 65, 66; 219/131 R, 131 W; 363/37

[56] References Cited

U.S. PATENT DOCUMENTS

| | | | |
|---|---|---|---|
| 3,789,266 | 1/1974 | Polman et al. | 315/DIG. 7 |
| 3,882,356 | 5/1975 | Stehlin | 315/DIG. 7 |
| 4,042,856 | 8/1977 | Steigerwald | 315/283 |
| 4,253,046 | 2/1981 | Gerhard et al. | 315/DIG. 7 |
| 4,471,269 | 9/1984 | Ganser et al. | 315/205 |
| 4,594,531 | 6/1986 | Ganser et al. | 315/DIG. 7 |
| 4,613,795 | 9/1986 | Itani et al. | 315/DIG. 7 |
| 4,614,898 | 9/1986 | Itani et al. | 315/DIG. 7 |
| 4,649,321 | 3/1987 | Ferraro | 315/DIG. 7 |

FOREIGN PATENT DOCUMENTS

| | | | |
|---|---|---|---|
| 3420229 | 12/1985 | Fed. Rep. of Germany | 315/DIG. 7 |

*Primary Examiner*—David K. Moore
*Assistant Examiner*—Michael J. Nickerson
*Attorney, Agent, or Firm*—David R. Treacy; Bernard Franzblau

[57] ABSTRACT

A circuit arrangement for A.C. operation of gas discharge lamps comprises a full-wave rectifier (1) connected to an alternating voltage source. The direct voltage is supplied to a combinatorial circuit part (3 to 8) in the form of a direct voltage converter, to which is connected a bridge circuit (9) which comprises four thyristors. The transverse branch of the bridge circuit includes the lamp (5). The full-wave rectifier (1) is followed by a smoothing capacitor (2) and an electronic switching element (14) is connected parallel to the bridge circuit (9). The switching element is switched to the conducting state in the vicinity of the zero passages of the input alternating voltage. As a result shortcircuits in the bridge circuit are avoided.

17 Claims, 2 Drawing Sheets

CIRCUIT ARRANGEMENT FOR A.C. OPERATION OF GAS DISCHARGE LAMPS

BACKGROUND OF THE INVENTION

This invention relates to a circuit arrangement for A.C. operation of at least one gas discharge lamp provided with a full-wave rectifier. The full wave rectifier is to be connected to an A.C. voltage source and has output terminals connected to a combinatorial circuit part in the form of a direct voltage converter, to which is connected a bridge circuit comprising at least two thyristors and in whose transverse branch the lamp is included. The term "thyristor" is to be understood herein to mean an electrical circuit element which is switched to the conducting state by a signal at its gate electrode, but which is switched to the non-conducting state only after the current has fallen below its hold current value. This also applies, for example, to the so-called triacs. The current fall is conventionally achieved by the zero passage of the voltage applied.

Such a circuit arrangement is known from DE OS No. 3136919. In this circuit arrangement, a combinatorial circuit part operating as a down converter produces a pulsatory direct voltage on which a high frequency may be superimposed. This pulsatory voltage is converted by a thyristor bridge, driven by the A.C. voltage source, into an A.C. voltage which varies with the frequency of the voltage source and on which may again be superimposed a given high-frequency modulation. In the known circuit arrangement, the down converter is fed by the A.C. voltage of the source rectified by means of a full-wave rectifier without the rectifier being followed by a smoothing capacitor.

However, such a circuit arrangement can only be used in given lamp types because, in the absence of a smoothing capacitor, reignition difficulties often occur during current zero passages. More particularly in high-pressure gas discharge lamps, it has been found in practice that generally smoothing capacitors of about 0.5 $\mu$F to 10 $\mu$F are required to maintain a residual ionization of the lamp in the zero passage of the current. The voltage at a smoothing capacitor, and hence at the thyristor bridge, does not fall to zero, however, upon the voltage zero passage of the source. Therefore, when using a smoothing capacitor, shortcircuits may occur in the thyristor bridge circuit, which may lead to extinction of the lamp and even to destruction of the circuit arrangement itself.

U.S. Pat. No. 4,042,856 discloses a similar circuit arrangement having an additional smoothing capacitor, in which the bridge circuit comprises four controlled transistors. In this case, the switching of the transistors is synchronized with the switching of the switching transistor in the combinatorial circuit part. Since transistors are switched into the conducting and non-conducting state by control at their gate electrodes, in this circuit arrangement practically no shortcircuit problems can occur in the transistor bridge.

SUMMARY OF THE INVENTION

Therefore, the invention has for an object to provide a circuit arrangement for A.C. operation of at least one gas discharge lamp comprising a thyristor bridge circuit, in which the rectified A.C. voltage is smoothed, but nevertheless shortcircuits in the thyristor bridge circuit are avoided under operating conditions.

According to the invention, this object is achieved in a circuit arrangement of the kind mentioned in the opening paragraph in that a smoothing capacitor is connected at the output terminals of the full-wave rectifier and parallel to the direct voltage converter and an electronic switching element is connected parallel to the bridge circuit, which element is switched to the conducting state in the vicinity of the A.C. voltage zero passages of the A.C. voltage source. The term "vicinity of the A.C. voltage zero passages" is to be understood in this description and the appended Claims to mean a period of time of not more than 10% of the source frequency period before to not more than 10% of this period after the zero passage. Thus, it is achieved that the current through the bridge thyristors falls below its hold current value, as a result of which the thyristors pass to the non-conducting state (switched off) and shortcircuits in the bridge are avoided. The time duration during which the current falls below the hold current value should be greater than the recovery time of the thyristors in order to guarantee with certainly that the thyristors are switched off.

Preferably, a current-limiting resistor is connected in series with the electronic switching element.

In order to limit to a minimum the losses in the electronic switching element and in the current-limiting resistor that may be connected in series with it, according to a further embodiment of the invention, in the conducting state of the electronic switching element, an electronic switch connected in series with it, included in the combinatorial circuit part and arranged between the smoothing capacitor and the bridge circuit is switched to the non-conducting state. This arrangement moreover has the advantage that the smoothing capacitor remains charged so that the reignition of the lamp is facilitated.

It has proved to be advantageous to the reignition behaviour of the lamp when that the electronic switching element be switched to the conducting state only shortly after the A.C. voltage zero passages of the A.C. voltage source. Likewise, it has proved to be advantageous for the electronic switch of the combinatorial circuit part to be switched to the non-conducting state only shortly after the A.C. voltage zero passages of the A.C. voltage source. The term "shortly" is to be understood to mean herein a time period between 0.1% and 10% of the source frequency period. According to a favourable embodiment of the circuit arrangement in accordance with the invention, the combinatorial circuit part and the electronic switching element are driven by a monostable multivibrator which is controlled by the A.C. voltage source and whose output pulses drive the electronic switching element and the electronic switch of the combinatorial circuit part in the rhythm of the A.C. voltage zero passages of the A.C. voltage source.

For feeding the monostable multivibrator, a further full-wave rectifier can be connected to the A.C. voltage source. The direct voltagge of this rectifier is supplied through a voltage divider to an input of the monostable multivibrator. In order to smooth the pulsatory D.C. voltage thus produced, a Zener diode is connected parallel to the input of the monostable multivibrator.

BRIEF DESCRIPTION OF THE DRAWING

In order that the invention may be readily carried out, it will now be described more fully, by way of example, with reference to the accompanying drawing, in which.

DESCRIPTION OF THE PREFERRED EMBODIMENTS

Figure 1:
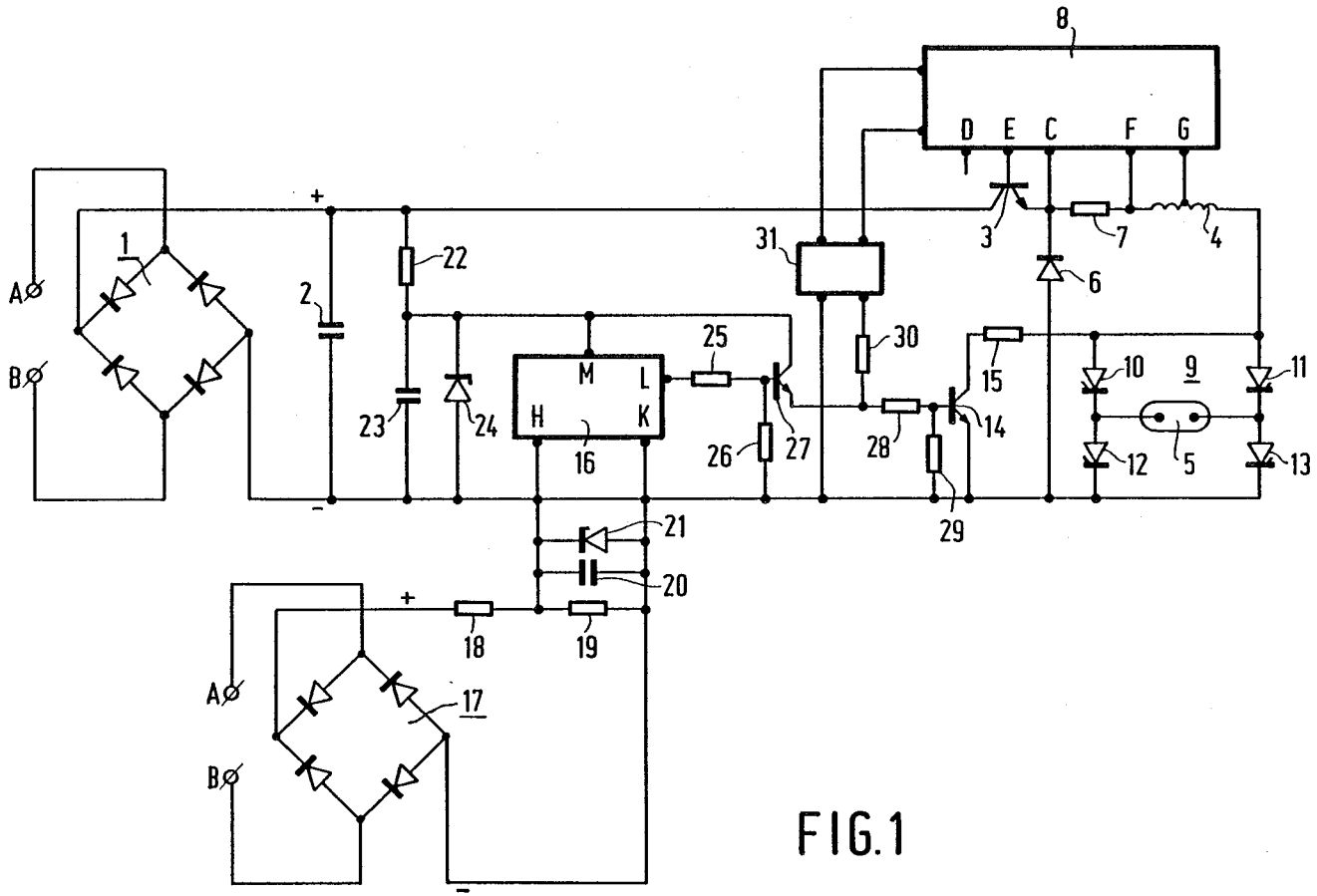
FIG. 1 shows a circuit arrangement for A.C. operation of a gas discharge lamp included in a thyristor bridge circuit and provided with a monostable multivibrator.

In FIG. 1, A and B designate input terminals for connection to an A.C. voltage source of, for example, 220 V, 50 Hz. A full-wave rectifier 1 comprising four diodes is connected to these input terminals A and B, as the case may be through a high-frequency filter (now shown). A smoothing capacitor 2 is connected parallel to the output terminals 1*a*, 1*b* of this rectifier. A combinatorial circuit part in the form of a direct voltage converter is connected to the output terminals 1*a*, 1*b* in parallel with this smoothing capacitor 2. The converter is in the form of a down converter and comprises an electronic switching element 3, for example a main switching transistor, a choke coil 4 and a fly-wheel diode 6. A bridge circuit 9 is connected to the direct voltage converter and a gas discharge lamp 5 is included in the transverse branch of this bridge. The smoothing capacitor 2 serves to facilitate the reignition of the lamp 5. Furthermore, a measuring resistor 7 serving as a current sensor is inserted in series with the lamp, from which resistor is derived an actual voltage which is proportional to the actual value of the instantaneous lamp current and which is supplied to an input C of a control device 8. By means of the control device 8, the lamp current tracks in known manner a nominal signal to be applied to an input D of the control device 8. The current derived from the A.C. voltage source should have a variation as sinusoidal as possible. The electronic switching element 3 is switched to the conducting and to the non-conducting state, respectively, by a signal occurring at an output E of the control device 8. A terminal F of the control device 8 is connected to ground. Through a terminal G, a supply voltage derived from the choke coil 4 is supplied to the control device 8.

Figure 2A:
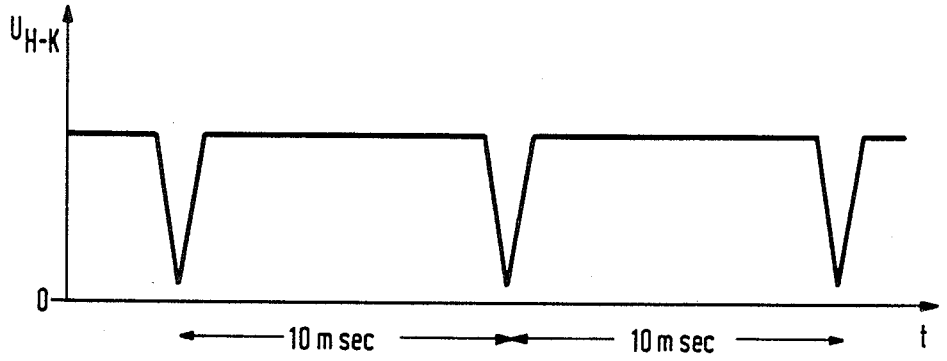
FIG. 2*a* shows the variation in time of the voltage applied to the input of the multivibrator.
Figure 2B:
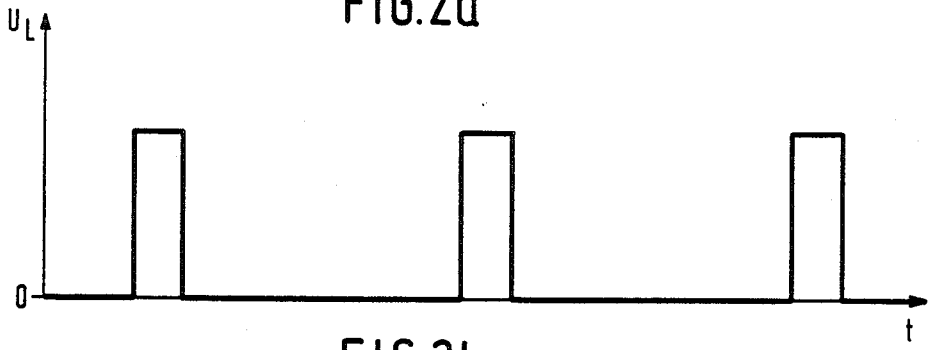
FIG. 2*b* shows the pulse train occurring at the output of the multivibrator.

The gas discharge lamp 5 is arranged in the transverse branch of the bridge circuit 9 which is connected parallel to the flywheel diode 6 and the choke coil 4. The bridge circuit comprises four thyristors 10 to 13, which can be triggered from the alternating voltage source. In this case, the ignition electrodes of the thyristors 10 to 13 could be connected in known manner (DE-OS No. 3136919) each time through a parallel-combination of a resistor, a capacitor and an oppositely polarized diode to the respective thyristor cathodes. Moreover, the ignition electrodes of each time two thyristors 10, 13 and 11, 12, respectively, arranged in the bridge circuit 9 diagonally opposite each other would when be connected each through a resistor and one of the input terminals A and B, respectively to the A.C. voltage source. For the sake of simplicity, the drive for the gate electrodes of the thyristors is not shown in the drawing. In order to avoid shortcircuits within the bridge circuit 9, an electronic switching element 14, for example a transistor, is connected parallel to it. This element is switched to the conducting state in the proximity of the A.C. voltage zero passages of the a.c. voltage source. The electronic switching element 14 is connected in series with a current-limiting resistor 15 and is driven by a monostable multivibrator 16, which serves to determine the zero passages of the A.C. voltage. For this purpose, a further full-wave rectifier 17 is connected to the A.C. voltage source and the direct voltage of this rectifier is supplied through a voltage divider comprising two resistors 18 and 19 to an input H-K of the monostable multivibrator 16. The multivibrator input voltage derived from the voltage divider resistor 19 is slightly smoothed by a capacitor 20 in order to suppress high-frequency interferences and is limited in peak voltage by means of a Zener diode 21 connected parallel to this capacitor. The voltage $U_{H-K}$ applied across the Zener diode 21 and hence to the input H-K of the monostable multivibrator 16 has the waveform shown diagrammatically in FIG. 2*a*. The pulse train ($U_L$) also shown only diagrammatically in FIG. 2*b* is then produced at an output L of the multivibrator 16. It is possible to adjust the monostable multivibrator 16 so that the beginning of the individual pulses lies on the trailing or leading edge of the signal shown in FIG. 2*a*. The pulse duration can also be determined by means of the multivibrator 16.

In order to provide a voltage supply for the monostable multivibrator 16 at a point M, and also for other circuit elements, use is made of a stabilized D.C. supply voltage of, for example, +10 V, which is produced in the usual manner by means of a resistor 22, a storage capacitor 23 and a Zener diode 24.

The base of a transistor 27 is acted upon by the output signal of the monostable multivibrator 16 (FIG. 2*b*) through a voltage divider 25,26. Its collector is connected to the D.C. supply voltage and its emitter is connected through a further voltage divider 28,29 to the base of the electronic switching element 14. The collector/emitter path of this electronic switching element 14 is arranged parallel to the thyristor bridge 9. This circuit arrangement ensures that with a positive output signal of the multivibrator 16 the electronic switching element 14 is conducting and hence shortcircuits the thyristor bridge 9, of shunts it by the current-limiting resistor 15 thereby effectively short circuiting the thyristor bridge.

In order to avoid inter alia a complete discharge of the smoothing capacitor 2 during the shortcircuit of the thyristor bridge 9, during the conducting state of the electronic switching element 14 the electronic switch 3 connected in series with it and included in the combinatorial circuit part should be switched to the non-conducting state. For this purpose, the emitter of the transistor 27 is connected through a current-limiting resistor 30 to the input of an opto-coupler 31, whose output signal is supplied to the control device 8. As a result, the control device 8 is acted upon by a pulse train which occurs simultaneously with the output pulse train of the multivibrator 16 and serves to switch the electronic switch 3 of the down converter, by means of the control device 8, to the non-conducting state for the same time for that it is the electronic switching element 14 is conducting. Thus, it is discharge of the smoothing capacitor 2 through the low-ohmic electronic switching element 14 and through the comparatively small current-limiting resistor 15 is avoided. As a result losses in this resistor and a substantial discharge of the smoothing capacitor 2 are avoided. Therefore, after the ignition of the thyristor bridge 9 the voltage of the smoothing capacitor 2, which is comparatively high during this operation, is again immediately applied to the lamp and permits its reignition.

With the circuit arrangement described, it was possible to operate satisfactorily metal halide and sodium high-pressure lamps. In an embodiment for operation of a 40 W metal halide lamp having a lamp operating voltage of 90 V, the most important elements of the circuit arrangement shown in FIG. 1 had the following values:

| | | |
|---|---|---|
| Transistor 3: | IRF 730 | of IR |
| Fly-wheel diode 6: | DSR 5500X | of TRW |
| Thyristors 10 to 13: | BT 149 | of Valvo |
| Transistor 27: | BC 107 | of Valvo |
| Transistor 14: | 2N 3439 | of Valvo |
| Multivibrator 16: | HEF 4538 | of Valvo |
| Choke coil 4: | 1 mH | |
| Smoothing capacitor 2: | 1 μF | |
| Capacitor 20: | 4.7 nF | |
| Capacitor 23: | 10 μF | |
| Resistor 18: | 100 kOhm | |
| Resistor 19: | 33 kOhm | |
| Resistor 22: | 100 kOhm | |
| Resistor 25: | 1.8 kOhm | |
| Resistor 26: | 6.8 kOhm | |
| Resistor 28: | 1.2 kOhm | |
| Resistor 29: | 10 kOhm | |
| Resistor 15: | 47 Ohm | |
| Resistor 30: | 390 Ohm | |
| Measuring resistor 7: | 1 Ohm | |
| Zener diodes 21, 24: | 10 V | |

Figure 2C:
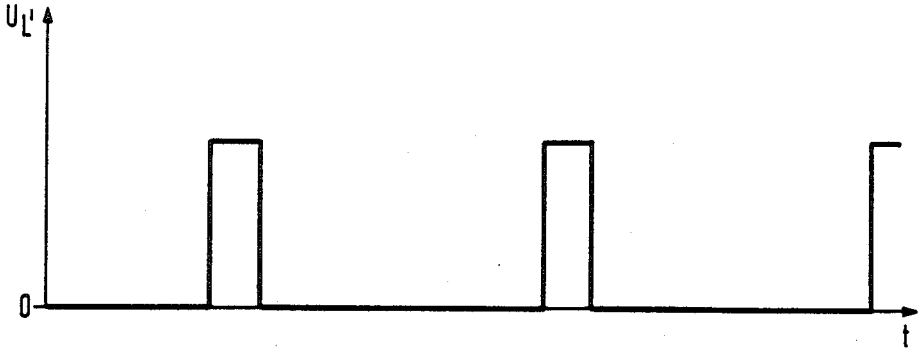
FIG. 2*c* shows a pulse train produced by a further monostable multivibrator and shifted in phase with respect to the mains zero passage.

Due to the fact that the multivibrator 16 is followed (not shown in the drawing) by a further monostable multivibrator, an output pulse train ($U_L'$) is produced, which is shifted in phase with respect to the mains zero passage (FIG. 2c) and which leads to a later extinction of the thyristors in the conductive branch of the bridge circuit. Preferably, this phase-shifted output pulse train should begin shortly after the zero passages of the A.C. voltage. However, the pulse is allowed to be shifted only through such a distance that at the instant of extinction the other branch of the bridge has not yet been ignited because otherwise shortcircuits can occur again. Due to the later extinction of the thyristors, it is achieved that the bridge current in the conductive branch and hence also the lamp current can still flow for a certain time after the zero passage of the A.C. voltage, while no current can flow in the case of immediate extinction upon the zero passage of this branch until the ignition of the other branch. Therefore, the delayed extinction of the thyristors favours the reignition behaviour of the gas discharge lamp. Typical values for the pulse duration are, for example, about 0.1 to 0.5 msec and 0.1 to 1 msec for the phase shift, therefore between 0.1% and 10% of the source frequency period.

It should further be noted that in the circuit arrangement according to the invention, the combinatorial circuit part need not necessarily be a down converter, but may also be constructed as a fly-back converter, a resonance converter or the like. Furthermore, the choke coil of the down converter may be arranged in series with the gas discharge lamp in the transverse branch of the bridge circuit. Moreover, it may be of advantage to connect a capacitor of, for example, 47 nF parallel to the thyristor bridge in order to avoid interferences.

What is claimed is:

1. A circuit arrangement for A.C. operation of at least one gas discharge lamp comprising: a full-wave rectifier for connection to an A.C. voltage source and having output terminals connected to a combinatorial circuit part including a direct voltage converter connected in turn to a bridge circuit which comprises at least two thyristors and in whose transverse branch the lamp is included, characterized in that a smoothing capacitor is connected to the output terminals of the full-wave rectifier and parallel to the direct voltage converter, an electronic switching element connected parallel to the bridge circuit, and means for switching the electronic switching element to the conducting state in the vicinity of the zero passages of the A.C. voltage source so as to effectively short circuit said bridge circuit.

2. A circuit arrangement as claimed in claim 1, characterized in that during the conducting state of the electronic switching element, an electronic switch, connected in series with it and included in the combinatorial circuit part and coupled between the smoothing capacitor and the bridge circuit, is switched to the non-conducting state.

3. A circuit arrangement as claimed in claim 1 wherein the electronic switching element is switched to the conducting state only shortly after the zero passages of the A.C. voltage source.

4. A circuit arrangement as claimed in claim 3 wherein the electronic switch of the combinatorial circuit part is switched to the non-conducting state only shortly after the A.C. voltage zero passages of the source.

5. A circuit arrangement as claimed in claim 2, characterized in that the switching means comprise a monostable multivibrator controlled by the A.C. voltage source and producing output pulses that drive the electronic switching element and the electronic switch of the combinatorial circuit part in the rhythm of the zero passages of the A.C. voltage source.

6. A circuit arrangement as claimed in claim 5, characterized in that a further full-wave rectifier is connected to the A.C. voltage source, the direct voltage of said further rectifier being supplied through a voltage divider to an input of the monostable multivibrator.

7. A circuit arrangement as claimed in claim 6, further comprising a Zener diode connected parallel to the input of the monostable multivibrator.

8. A circuit arrangement as claimed in claim 2 wherein the electronic switching element is switched to the conductive state only shortly after the zero passages of the A.C. voltage source.

9. A circuit arrangement as claimed in claim 1 wherein the combinatorial circuit part includes an electronic switch connected in series with the electronic switching element and coupled between the smoothing capacitor and the bridge circuit, and second means for switching said electronic switch to the cut-off state during the conductive state of the electronic switching element and only shortly after the zero passages of the A.C. voltage source.

10. A circuit for A.C. operation of at least one electric discharge lamp comprising: rectifying means having input terminals for connection to a source of low frequency A.C. voltage and output terminals, a direct voltage converter having input means coupled to the output terminals of the rectifying means, a bridge circuit connected to said direct voltage converter, said bridge circuit including at least two controlled thyristors and with a discharge lamp connected across output terminals of the bridge circuit, a smoothing capacitor connected across the output terminals of the rectifying means and parallel to the direct voltage converter, a controlled electronic switching element connected in parallel with the bridge circuit, and means coupled to a control electrode of said switching element for switching said switching element into conduction in the vicinity of the zero passages of the A.C. voltage source so as to limit the voltage across the bridge circuit to a low value sufficient to insure cut-off of one or more of said thyristors.

11. A circuit as claimed in claim 10 wherein the direct voltage converter includes a second controlled electronic switching element coupled in series with the bridge circuit and in series with the first switching element across the smoothing capacitor, and said switching means switches the second switching element into cut-off during the same time it switches the first switching element into conduction thereby to inhibit discharge of the smoothing capacitor via said first switching element.

12. A circuit as claimed in claim 10 wherein the switching means applies to a control electrode of the first switching element a switching control signal whose time period is determined by the recovery time of said thyristors.

13. A circuit as claimed in claim 10 wherein the direct voltage converter includes a second controlled electronic switching element connected in series with an inductor and said bridge circuit across the smoothing capacitor, and the switching means includes a control device whose supply voltage is derived from said inductor.

14. A circuit as claimed in claim 10 wherein the discharge lamp comprises a high-pressure discharge lamp.

15. A circuit as claimed in claim 10 wherein the direct voltage converter includes a second controlled electronic switching element coupled in series with the bridge circuit across the smoothing capacitor, and the switching means includes first and second control devices for supplying first and second switching control signals to control electrodes of the first and second switching elements, respectively, means for deriving a further control signal proportional to lamp current, and wherein said second control device is responsive to said further control signal and to said first switching control signal to derive said second switching control signal.

16. A circuit as claimed in claim 10 wherein the controlled electronic switching element is connected in parallel with the bridge circuit by means of a D.C. connection.

17. A circuit as claimed in claim 11 wherein said first and second switching elements comprise first and second transistors, respectively, polarized to conduct current in the same direction as seen from terminals of the smoothing capacitor.

* * * * *